US005202170A

United States Patent [19]

Hsu et al.

[11] Patent Number: 5,202,170

[45] Date of Patent: Apr. 13, 1993

[54] PAPERMAKING FELT WITH A NON-SPIRALLED MACHINE DIRECTION FIBER BATT

[75] Inventors: Chien-Yeh Hsu, Greer; Vaughn M. Renwick, Clinton, both of S.C.

[73] Assignee: Wangner Systems Corporation, Greenville, S.C.

[21] Appl. No.: 681,771

[22] Filed: Apr. 8, 1991

[51] Int. Cl.[5] ..... B32B 5/06; B32B 5/08; D21F 3/02; D21F 7/08

[52] U.S. Cl. ..... 428/48; 28/110; 162/358.2; 162/900; 428/55; 428/58; 428/113; 428/234

[58] Field of Search ..... 162/358.2, 900; 428/48, 428/55, 58, 113, 234; 28/110

[56] References Cited

U.S. PATENT DOCUMENTS 3,097,413 7/1963 Draper ..... 28/110
3,920,511 11/1975 Grieves ..... 162/348
4,536,927 8/1985 Feyerl et al. ..... 28/110
4,614,969 9/1986 Gerundt et al. ..... 28/110
4,701,986 10/1987 Gunther et al. ..... 28/110
4,777,706 10/1988 Stanislaw ..... 28/110
4,878,278 11/1989 Hsu et al. ..... 28/110

FOREIGN PATENT DOCUMENTS 2324985 1/1974 Fed. Rep. of Germany ..... 28/110
3315 1/1971 Japan ..... 28/110

*Primary Examiner*—James C. Cannon
*Attorney, Agent, or Firm*—Cort Flint; Henry S. Jaudon

[57] ABSTRACT

A paper machine felt comprising a base fabric of a predetermined width and length, a plurality of fiber batts having a predetermined length and width with fibers forming the fiber batts extending in the width direction, the fiber batts being arranged to extend along their length in juxtaposed manner across the width of the base fabric and to be intertangled therewith by needling so that the fibers extend in the length direction of the base fabric.

12 Claims, 3 Drawing Sheets

PAPERMAKING FELT WITH A NON-SPIRALLED MACHINE DIRECTION FIBER BATT

BACKGROUND OF THE INVENTION

This invention relates to manufacture of papermaking fabrics and particularly to wet felts and occasionally dryer fabrics.

Over the years, papermakers have used developments in wet felt design to improve water removal in the presses of papermaking machinery. With the advent of monofilament and multifilament yarns in the 1960's, "batt-on-base" and "batt-on-mesh" designs were introduced. In these designs, carded batts are needled into woven base fabrics.

Conventionally, several layers of batt are cross-lapped onto the base fabric in the cross-machine direction. For example, see U.S. Pat. No. 3,257,259. When the batts are cross-lapped upon the base fabric for needling, the fibers are generally oriented in the cross machine direction rather than the machine direction. In the case of wet felts, water must be pressed from the felt for water removal from the paper fiber matt. Cross-machine oriented fibers are thought to restrict the lateral movement of the water and adversely affect water removal from the sheet.

Related U.S. Pat. Nos. 3,879,820 and 3,920,511 disclose a papermaker's felt and method in which the fibers are oriented substantially longitudinally to make a substrate by using numerous transfers of the batt upon aprons, reorientations along tortuous paths, and other batt manipulations in a rather complicated manner. A batt is then needled to the substrate crosswise to the felt travel.

U.S. Pat. Nos. 4,553,289; 1,953,457; and 3,713,933 relate generally to the art of building up fibrous batts either in juxtaposed or superposed relation. In the first two patents, general batts are reoriented 90 degrees by using angularly disposed guide rods so that the resulting batt is aligned lengthwise with a conveyer. These patents are related only generally and not directly to the present invention.

U.S. Pat. No. 4,878,278 relates generally to the act of applying fiber batts to the base fabric in the machine direction of the papermaking fabric. As the fibers forming the batt extend in the length direction of the batt, they are arranged to extend in the machine direction of the papermaking felt. A major drawback to this method is that jointing must occur sequentially as each batt must be attached to the base fabric as it is positioned thereon. Also, starting and ending lines appear lengthwise the felt across the width thereof. Any over or under lapping of these lengthwise splice lines may cause lengthwise marking of the paper.

In view of the above disadvantages, it is an object of the invention to apply the batts cross-machine-wise while using batts having machine direction oriented fibers on the felts. The benefits of such batts can be twofold: (1) by eliminating the butt joint in the batt, the tendency of lengthwise sheet marking is greatly reduced; and (2) the surface of such felts is exceptionally smooth and lacks needle marks. This not only enhances the water removal due to more uniform pressure application from the press rolls to the sheet, but also improves the surface quality of the sheet for the lack of needle marks.

Another object of the invention is to provide a method and apparatus for making a papermakers felt which includes a fiber batt needled into a base fabric in which the fibers in the fiber batt extend generally in the machine direction which facilitates water removal as well as to improves the sheet quality.

Another object of the invention is to provide a wet felt having machine direction oriented fibers which are laid upon a base fabric and needled without excessive fiber manipulation.

Still another object of the invention is to provide a wet felt in which the fiber batts extend transversely across the entire width of the base fabric while at the same time having the fibers forming the batts extending in the length direction of the base fabric so that full width needling of the batt to the base fabric is facilitated.

Still another object of the invention is to produce a felt with an under layer of the batt fibers oriented in cross-machine direction and the top layers of the batt fibers oriented in the machine direction so as to create a "shingle" effect of the batt fibers. Such structure is believed to have better compaction resistance.

SUMMARY OF THE INVENTION

The above objectives are accomplished according to the invention by laying fiber batts onto a base fabric transverse to the machine direction of the papermaking felt. The fibers forming the batt are arranged to extend transverse to the length direction of the batt. This results in the fibers of the batt extending in the machine direction of the felt while at the same time facilitating full width needling of the batts. As a result the fibers are needled into the base fabric with a minimum of fiber manipulation.

A wet felt press felt comprises a dimensionally stable base fabric having an upper and lower surface. A plurality of juxtaposed fiber batts are needled to the base fabric. The fiber batts are arranged to extend across the width of the base fabric substantially transverse to a machine direction of the felt. The individual fibers which form the batts extend substantially transverse to the length direction of the batts.

A wet press felt which has a machine direction and a width direction and includes a plurality of fiber batts needled to a base fabric. The fiber batts are arranged to extend across the width of the base fabric substantially transverse to the machine direction with fibers forming the fiber batts arranged to extend substantially parallel with the machine direction. The fiber batts are arranged so that adjacent edges of adjacent fiber batts are in contact across the width of the base fabric. A plurality of layers of fiber batts may be arranged across the base fabric and/or the fiber batts may be arranged on both upper and lower surfaces of the base fabric. The fiber batts are needled across the full width of the base fabric by a full width needling operation. The orientation of the fibers in the batt can be arranged so that the fibers in the under layers are oriented in cross-machine direction, whereas the fibers in the top layers of the batt are oriented in machine direction.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The papermaking fabric of the present invention is primarily intended for use in the wet end of the papermaking operation and is hereinafter referred to as a wet felt. It is noted that the invention is not limited to this phase of the papermaking operation.

Any number of base fabrics may be employed depending upon the intended use and quality desired of the paper produced. The base fabric may be woven or spiral based and it may be multi-ply or single ply. Any of the commonly used weave structures such as a plain weave, or 2/2, 3/1, 3/2, twill, broken twill, and satin weaves may be used. Likewise, any known coil configuration may be used in the spiral based fabrics.

The base fabric is preferably formed of monofilament polyamide yarns having a diameter of approximately 0.2 mm to 0.8 mmm. Again, other synthetic materials of varying diameters as are known in the art may be used.

The batt preferably is comprised of polyamide fibers having a fineness of no less than 3 denier. The density of the batt is preferably 0.10 to 0.60 grams per cubic centimeter. These preferences are not essential to the invention and batts of various sizes and densities formed of varying sized yarns may be employed.

Figure 5:
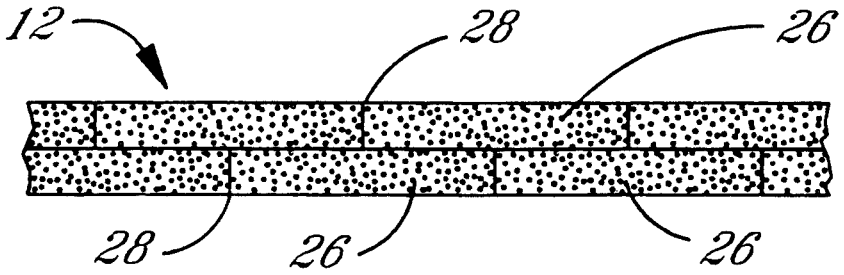
FIG. 5 is a sectional side view of a preferred batt construction.
Figure 6:
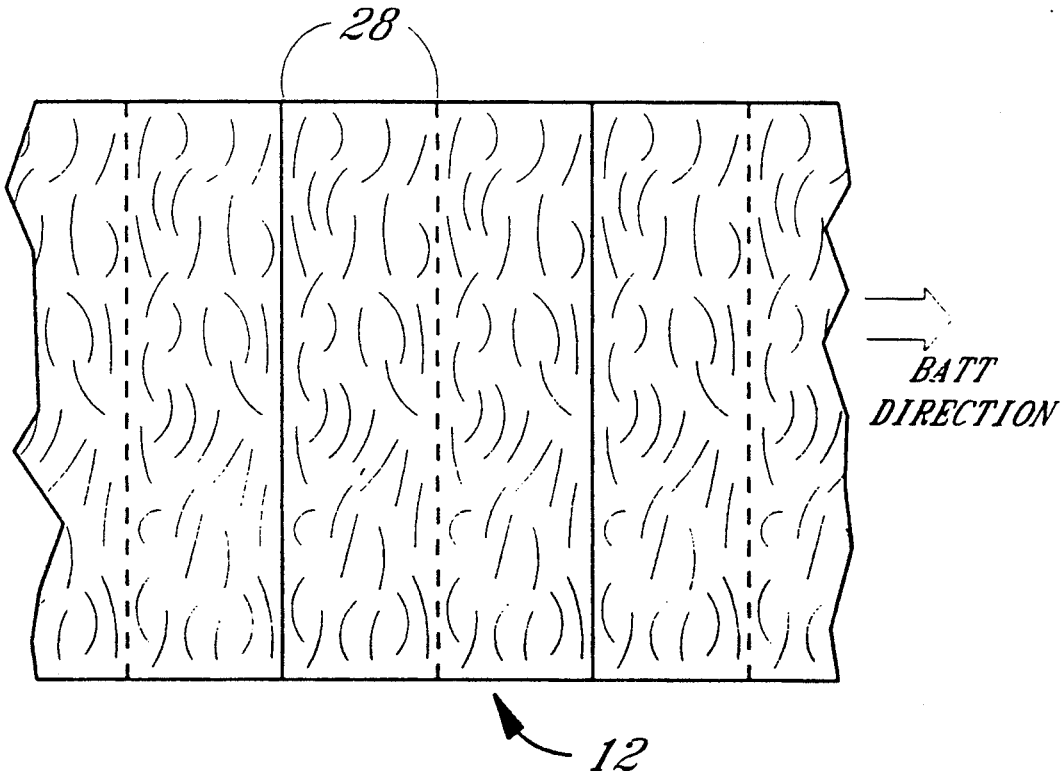
FIG. 6 is a sectional top view of a preferred fiber batt construction.

A preferred construction of batt 12 is shown in FIGS. 5 and 6. As can be seen, batt 12 is comprised of a plurality of fiber pads 26 arranged in at least two layers. Each pad is approximately 2 m in length and width, although these dimensions may be varied as desired. The fibers of each pad 26 extend in direction B, i.e. transverse to the length direction of batt 12. it is desirable that pads 26 of one layer be arranged to overlay the abutting edges 28 of the pads of the opposite layer as is clearly illustrated in FIGS. 5 and 6. The lower fibers of upper pads 26 are slightly entangled with the upper fibers of lower pads 26 to form a continuous batt 12.

Figure 1:
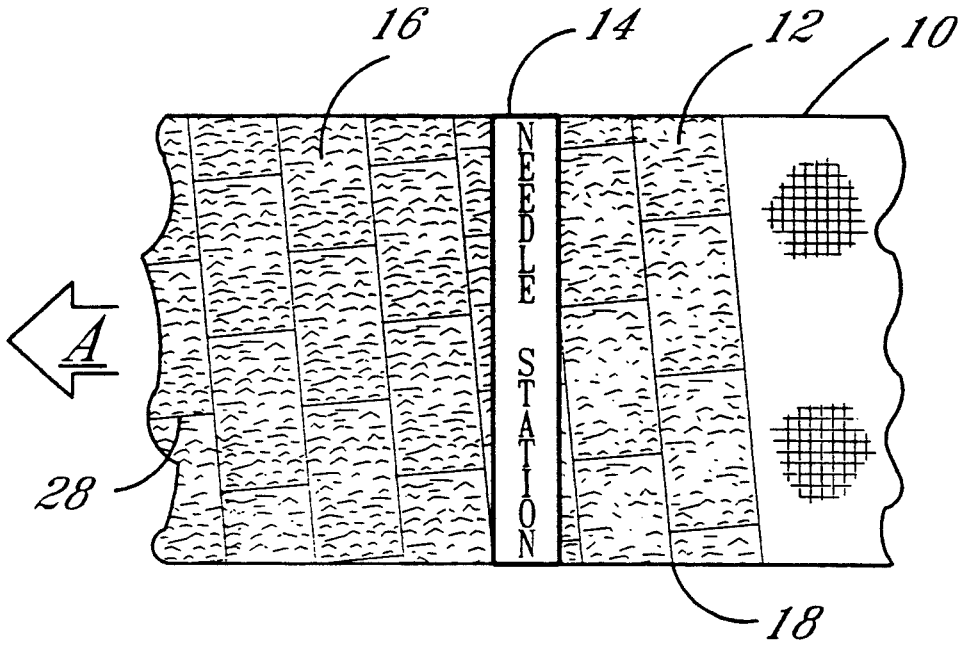
FIG. 1 is a top plan view of an arrangement according to the invention.

Referring now to FIG. 1, it can be seen that base fabric 10, which can be woven in the form of a continuous loop or woven flat and joined into a loop, is positioned to extend beneath needle loom 14. Fiber batts 12 are applied with a standard cross lapper and are arranged at a slight angle across the width of base fabric 10. The fibers forming the batt extend in direction A which is the length direction of base fabric 10 or the machine direction of the felt.

The base fabric 10, having batts 12 extending transversely thereof is moved beneath needle loom 14 where full width needling takes place producing wet felt 16. The process is continued until the desired number of layers of batt is applied to the base fabric 10.

Figure 2:
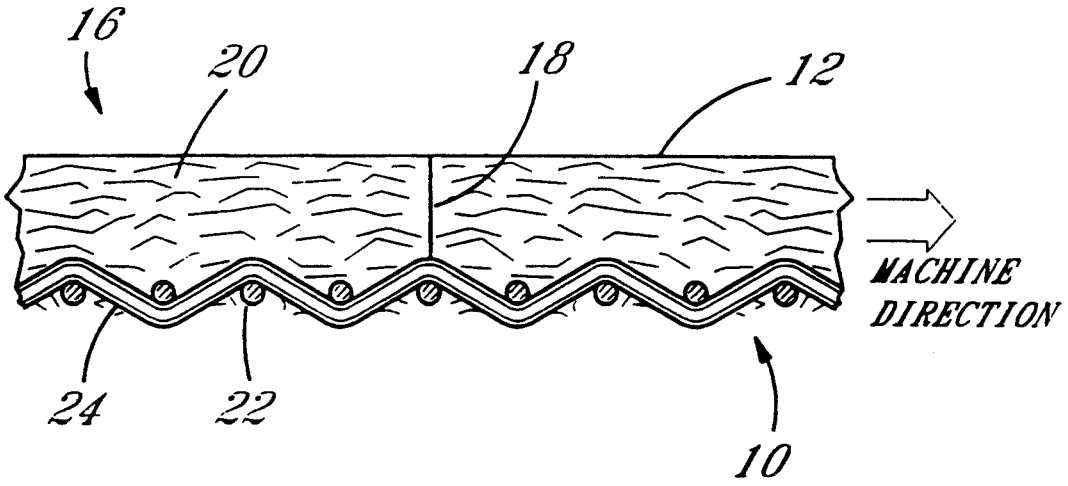
FIG. 2 is a sectional side view of the wet felt according to the invention in which the batt fibers are oriented in the machine direction.

The batts 12 are arranged across the entire width of the base fabric 10 with their transverse edges 18 in juxtaposed relationship as shown in FIGS. 1 and 2. FIG. 2 further shows wet felt 16 of the invention consisting of batts 12 needled to base fabric 10. Fabric 10 is shown as a plain weave having weft yarns 24 and fibers 20 extending in the machine or lengthwise direction of the wet felt. Warp yarns 22 weave with weft yarns 24 to form the base fabric in a continuous loop. The base fabric could just as well be flat woven, cut to length and joined to form a loop. In this instance, warp yarns 22 would extend in the machine direction.

Figure 3:
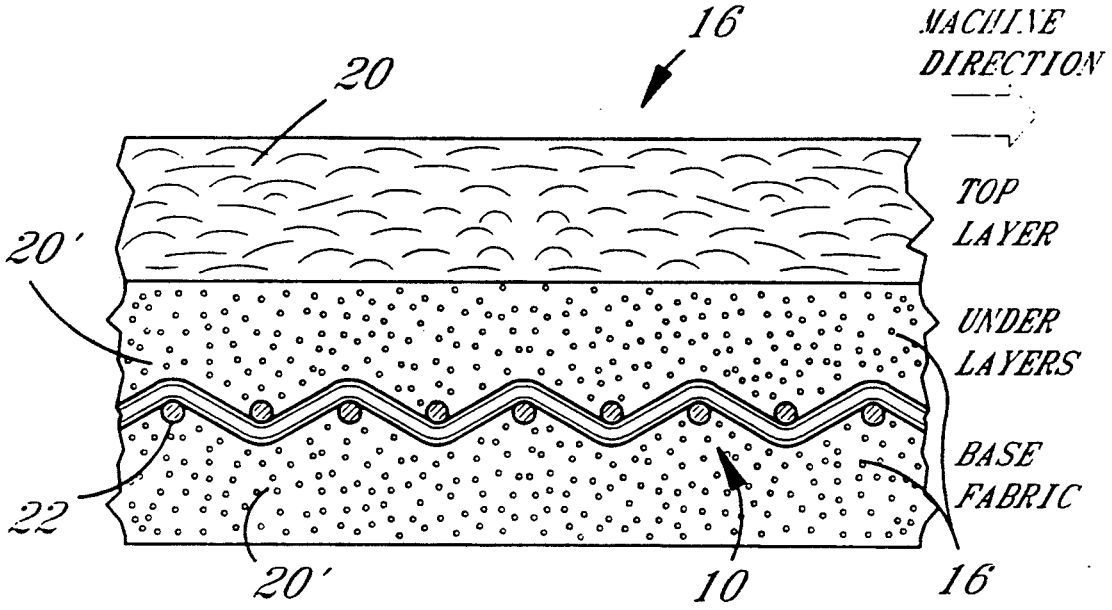
FIG. 3 is a sectional side view of the wet felt according to the invention in which the under layer batt fibers are oriented in the cross-machine direction and top layer batt fibers ar oriented in the machine direction.

FIG. 3 shows the same base fabric 10 in which batts have been applied to both its upper and lower surfaces. Batt fiber 20' of lower layer 16', which are adjacent the base fabric 10, are oriented in the cross-machine direction. Batt fibers 20 of upper layer 16 are oriented in the machine direction.

Figure 4:
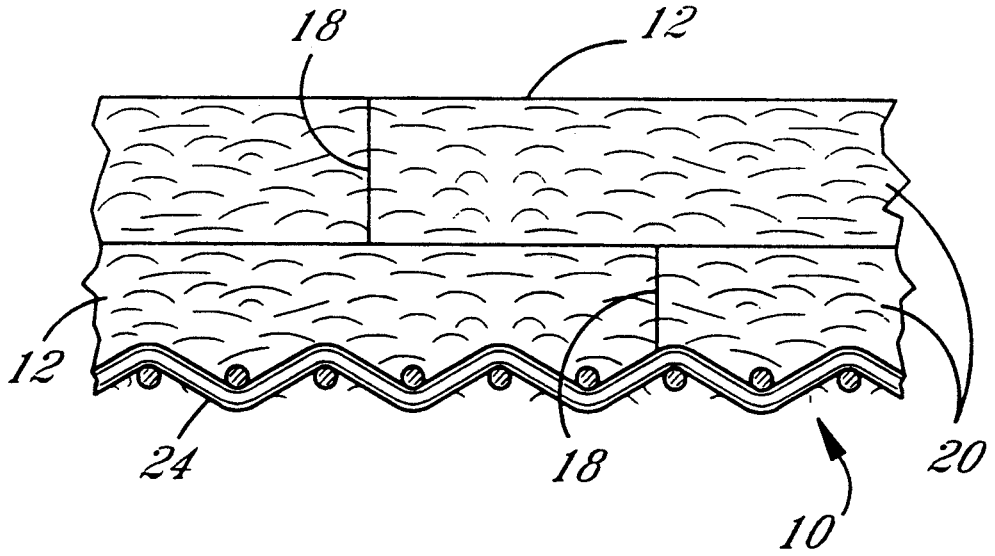
FIG. 4 is a sectional side view of the wet felt according to the invention in which a plurality of layers of fiber batts, all having machine direction oriented fibers, are employed.

FIG. 4 shows a third embodiment of the invention. Here, two layers of fiber batt 12 are applied to the upper surface of base fabric 10. Fibers 20 forming each batt 12 are oriented to extend in the machine direction, which in this instance corresponds with the direction of weft yarns 24.

Thus, it can be seen that an advantageous method of producing a wet felt and a superior wet felt can be had in accordance with the invention. A fiber batt can be needled to a base fabric with its fibers oriented in the machine direction without the necessity of manipulating the fiber batt or turning the batt at angles for feeding. The fiber batt may be fed directly from the feed rolls at a slight angle but in a generally straight line upon the base fabric to be fully needled to the base fabric by a full width needle loom.

While a preferred embodiment of the invention has been described using specific terms, such description is for illustrative purposes only, and it is to be understood that changes and variations may be made without departing from the spirit or scope of the following claims.

What is claimed is:

1. A wet felt press felt comprising:

a dimensionally stable base fabric having an upper and lower surface;

a plurality of juxtaposed fiber batts needled to said base fabric;

said fiber batts are arranged to extend across the width of said base fabric substantially transverse to a machine direction of said felt; and individual fibers forming said batts extend substantially transverse to the length direction of said batts; whereby said wet press felt includes a base fabric having transversely disposed fiber batts needled thereto with the fibers forming said batts extending in the machine direction of said felt.

2. A wet press felt having a machine direction and a width direction including:

a plurality of fiber batts needled to a base fabric; and said fiber batts are arranged to extend across the width of said base fabric substantially transverse to said machine direction with fibers forming said fiber batts arranged to extend substantially parallel with said machine direction.

3. The wet press felt of claim 2 wherein said fiber batts are arranged so that adjacent edges of adjacent fiber batts are in contact across the width of said base fabric.

4. The wet press of claim 2 wherein a plurality of layers of fiber batts are arranged across said base fabric.

5. The felt of claim 4 wherein said fibers forming the batts of lower layers are arranged to extend in the cross-machine direction and said fibers forming said batts of upper layers are arranged to extend in the machine direction.

6. The felt of claim 2 wherein the fiber batts are needled across the full width of said base fabric by a full width needling operation.

7. The felt of claim 2 wherein said fiber batts are needled to upper and lower surfaces of said base fabric.

8. A paper machine felt comprising:

a base fabric of a predetermined width and length;

a plurality of fiber batts having a predetermined length and width with fibers forming said fiber batts extending in the fiber batt width direction; and said fiber batts being arranged to extend along their length in juxtaposed manner across said width of said base fabric and to be intertangled therewith by needling so that said fibers extend in said length direction of said base fabric.

9. The wet press felt of claim 8 wherein said fiber batts each comprise a plurality of fiber pads arranged in abutting relationship.

10. The wet press felt of claim 9 wherein said fiber batts comprise a plurality of layers of said fiber pads.

11. The wet press felt of claim 10 wherein said fiber pads of one layer overlap the abutting ends of said fiber pads of an adjacent layer.

12. The method of forming a wet press felt comprising:

providing a dimensionally stable base fabric having a pre-determined width and length;

providing a fiber batt of pre-determined width and indeterminate length with fibers forming said fiber batt extending in the fiber batt width-wise direction;

laying a length of fiber batt transversely across said base fabric while moving said base fabric toward a full width needling station;

successively laying subsequent fiber batt lengths across said base fabric in juxtaposed positions; and sequentially needling said fiber batts to said base fabric via said full width needling station.

* * * * *